US011267679B2

(12) United States Patent
Fonteneau

(10) Patent No.: US 11,267,679 B2
(45) Date of Patent: Mar. 8, 2022

(54) ELEVATOR CAR APRON

(71) Applicant: Otis Elevator Company, Farmington, CT (US)

(72) Inventor: Nicolas Fonteneau, Chateauneuf sur Loire (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 116 days.

(21) Appl. No.: 16/531,616

(22) Filed: Aug. 5, 2019

(65) Prior Publication Data

US 2020/0048049 A1 Feb. 13, 2020

(30) Foreign Application Priority Data

Aug. 10, 2018 (EP) ..... 18306103

(51) Int. Cl.
*B66B 13/28* (2006.01)
*B66B 11/00* (2006.01)
*B66B 13/30* (2006.01)

(52) U.S. Cl.
CPC ..... *B66B 13/285* (2013.01); *B66B 11/0005* (2013.01); *B66B 13/301* (2013.01)

(58) Field of Classification Search
CPC . B66B 13/285; B66B 11/0005; B66B 13/301; B66B 13/28; F16F 7/09
See application file for complete search history.

(56) References Cited

U.S. PATENT DOCUMENTS 1,993,285 A 3/1935 Samuel
7,621,379 B2 * 11/2009 Miller ..... B66B 13/301 187/400
8,079,447 B2 12/2011 Zuercher
(Continued)

FOREIGN PATENT DOCUMENTS

CH 698089 B1 5/2009
CN 204310630 U 5/2015
(Continued)

OTHER PUBLICATIONS

Crash Protection for Elevator Installations, Nov. 16, 2011, English machine translation of DE 202011051638 U1 (Year: 2011).*
(Continued)

*Primary Examiner* — Michael R Mansen
*Assistant Examiner* — Michelle M Lantrip
(74) *Attorney, Agent, or Firm* — Cantor Colburn LLP

(57) ABSTRACT

Elevator systems are described. The systems include an elevator car movable along an elevator shaft having a pit floor. A car apron assembly is provided that includes an apron frame movably mounted to the elevator car, the apron frame having a frame base, a support arm, and an apron stop at an end of the support arm opposite the frame base, and a semi-rigid curtain extending between a car sill and the frame base. A shaft stop is arranged within the elevator shaft to interact with the apron stop. The curtain transitions from a deployed state to a compressed state when the apron stop contacts the shaft stop, and when in the deployed state the curtain extends below the elevator car to block an open landing door that is lower than the elevator car when the elevator car is positioned offset and above an adjacent landing.

19 Claims, 5 Drawing Sheets

(56) References Cited

U.S. PATENT DOCUMENTS

| | | | | |
|---|---|---|---|---|
| 8,469,155 | B2 * | 6/2013 | Thomsen | B66B 13/285 187/401 |
| 2003/0217895 | A1 * | 11/2003 | Kigawa | B66B 5/282 187/344 |
| 2007/0181377 | A1 * | 8/2007 | Ketonen | B66B 13/285 187/314 |
| 2014/0008158 | A1 * | 1/2014 | Fauconnet | B66B 13/285 187/400 |

FOREIGN PATENT DOCUMENTS

| | | | | |
|---|---|---|---|---|
| CN | 204823596 | U | 12/2015 | |
| CN | 204958077 | U | 1/2016 | |
| CN | 105384020 | A | 3/2016 | |
| CN | 105460722 | A | 4/2016 | |
| CN | 106081804 | A | 11/2016 | |
| CN | 106276511 | A | 1/2017 | |
| CN | 104627792 | B | 2/2017 | |
| CN | 105060086 | B | 3/2017 | |
| CN | 206783048 | U | 12/2017 | |
| DE | 20202775 | U1 * | 8/2002 | B66B 13/285 |
| DE | 102008038408 | A1 | 3/2009 | |
| DE | 202011051638 | U1 * | 11/2011 | B66B 5/0081 |
| DE | 102008038409 | B4 | 12/2016 | |
| EP | 1118576 | B1 | 4/2005 | |
| EP | 1854758 | A1 | 11/2007 | |
| EP | 2138443 | A1 | 12/2009 | |
| EP | 1871972 | B1 | 5/2014 | |
| EP | 2183455 | B1 | 9/2014 | |
| EP | 2328826 | B1 | 11/2014 | |
| EP | 2581334 | B1 | 8/2016 | |
| EP | 2459835 | B1 | 1/2017 | |
| EP | 3012218 | B1 | 2/2017 | |
| EP | 3251995 | A1 | 12/2017 | |
| FR | 1307350 | A | 10/1962 | |
| FR | 2912390 | B1 | 4/2009 | |
| JP | 2005145610 | A | 6/2005 | |
| JP | 3714776 | B2 | 11/2005 | |
| JP | 2006264809 | A | 10/2006 | |
| JP | 2014034431 | A | 2/2014 | |
| WO | 0210053 | A1 | 2/2002 | |
| WO | 2012137032 | A1 | 10/2012 | |

OTHER PUBLICATIONS

Armoured Aprons. Beakbane. Retrieved from https://www.beakbane.co.uk/en/homepage/. Jul. 1, 2018. 3 Pages.

European Search Report for European Application No. 18306103.5, International Filing Date Aug. 10, 2018, dated Apr. 11, 2019, 9 pages.

The New Evolution compact. A One-of-a-kind Elevator, with Shallow 300 mm Recess. ThyssenKrupp Aufzugswerke GmbH. A Company of ThyssenKrupp Elevator. Retrieved from: www.thyssenkrupp-aufzuege.com. Date Assessed: Aug. 16, 2018. 6 Pages.

* cited by examiner 400
412
420
422
410
424
418
414
416

400
412
424
422
420
418
410
414
428

424
422
428
412
426
430
420
418
410
414
400

ELEVATOR CAR APRON

CROSS REFERENCE TO RELATED APPLICATIONS

This application claims the benefit of European Application No. 18306103.5, filed Aug. 10, 2018, which is incorporated herein by reference in its entirety.

BACKGROUND

The subject matter disclosed herein generally relates to elevator systems and, more particularly, to elevator car aprons and safety mechanisms for elevator systems.

Traditional safety requirements for elevator shafts have led to larger spaces both at the top and bottom of the elevator shaft. However, such enlarged spaces may be disadvantageous for architectural reasons. Thus, elevator manufacturers have attempted to reduce hoistway or elevator shaft overhead dimensions and pit depth while maintaining safety features. Mechanics currently go to the top of car, or on top thereof, or in the pit, for inspection or maintenance activity of various components of an elevator car system. Thus, safety spaces or volumes are employed within the elevator shaft to protect a mechanic in the event of an emergency and thus require increased overhead and pit dimensions.

Further advancements and designs have attempted to completely eliminate the need for a mechanic to enter the hoistway, thus improving safety. An advantage of eliminating the need for entering the hoistway is that the traditional large pit depths may be reduced such that very small pit depths may be employed in such elevator systems.

Elevator cars typically include a toe guard or car apron situated beneath the elevator car door. The car apron is arranged to prevent persons from falling into an elevator shaft if the elevator car is not located at a landing and the landing doors are opened. The car apron is typically rigid and has a nominal height of about 750 mm. A significant amount of clearance beneath the elevator car is required to avoid contact between the car apron and the bottom of the elevator shaft when the elevator car is situated at a lowest landing. Such contact could cause significant damage to the car apron due to the rigid and fixed nature of the car apron. Accordingly, retractable car aprons have been proposed to address the above issues for systems employing small pit depths. However, improved systems may be advantageous.

BRIEF SUMMARY

According to some embodiments, elevator systems are provided. The elevator systems include an elevator car movable along an elevator shaft, the shaft having a pit floor, the elevator car having an elevator car door sill and a car apron assembly. The car apron assembly includes an apron frame movably mounted to the elevator car, the apron frame having a frame base, a support arm, and an apron stop at an end of the support arm opposite the frame base; a semi-rigid curtain attached to the elevator car door sill and extending to the frame base; and a shaft stop arranged within the elevator shaft at a stop height from the pit floor, the shaft stop positioned within the elevator shaft to interact with the apron stop. The semi-rigid curtain transitions from a deployed state to a compressed state when the apron stop contacts the shaft stop and as the elevator car moves toward the pit floor, and when in the deployed state the semi-rigid curtain extends below the elevator car to block an open landing door that is lower than the elevator car when the elevator car is positioned offset and above an adjacent landing.

In addition to one or more of the features described above, or as an alternative, further embodiments may include that the semi-rigid curtain is formed from at least one of rubber, plastic, fabric, metallic chain links, plastic chain links, metal mesh, and plastic mesh.

In addition to one or more of the features described above, or as an alternative, further embodiments may include that the semi-rigid curtain has as deployed length LD in the deployed state and a compressed length LC in the compressed state, wherein the compressed length LC is less than the deployed length LD.

In addition to one or more of the features described above, or as an alternative, further embodiments may include that the semi-rigid curtain has a length of between 750 mm and 5 meters in the deployed state and between 0 and 750 mm in the compressed state, in particular having a length of about 750 mm in the deployed state and about 180 mm in the compressed state.

In addition to one or more of the features described above, or as an alternative, further embodiments may include that the shaft stop is fixedly connected to at least one of a shaft wall, a landing door frame, and a guide rail.

In addition to one or more of the features described above, or as an alternative, further embodiments may include a biasing assembly through which the support arm having the apron stop passes, wherein the biasing assembly applies a biasing force to urge the apron frame into the deployed state.

In addition to one or more of the features described above, or as an alternative, further embodiments may include that the biasing assembly comprises a housing and a biasing element within the housing.

In addition to one or more of the features described above, or as an alternative, further embodiments may include that the housing of the biasing assembly comprises a first end with a first aperture in the first end and a second end with a second aperture in the second end, wherein the support arm passes through the housing from the first end to the second end.

In addition to one or more of the features described above, or as an alternative, further embodiments may include that the biasing element is a spring.

In addition to one or more of the features described above, or as an alternative, further embodiments may include that the support arm comprises a flange that is arranged to apply force to the biasing element when the apron stops contact the shaft stops.

In addition to one or more of the features described above, or as an alternative, further embodiments may include that the biasing assembly is mounted to the elevator car.

In addition to one or more of the features described above, or as an alternative, further embodiments may include that the biasing assembly is mounted to at least one of a frame of the elevator car and a panel of the elevator car.

In addition to one or more of the features described above, or as an alternative, further embodiments may include that the semi-rigid curtain provides a horizontal resistance of between 200-700 N with a 5-50 mm deflection, in particular with a horizontal resistance of about 300 N with about a 35 mm deflection.

In addition to one or more of the features described above, or as an alternative, further embodiments may include that the apron frame comprises a second support arm having an associated second apron stop and wherein a second shaft stop is arranged within the elevator shaft to interact with the second apron stop.

In addition to one or more of the features described above, or as an alternative, further embodiments may include that the first and second support arms and the first and second apron stops are located on opposite sides of the elevator car.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited by the accompanying figures in which like reference numerals indicate similar elements.

DETAILED DESCRIPTION

Figure 1:
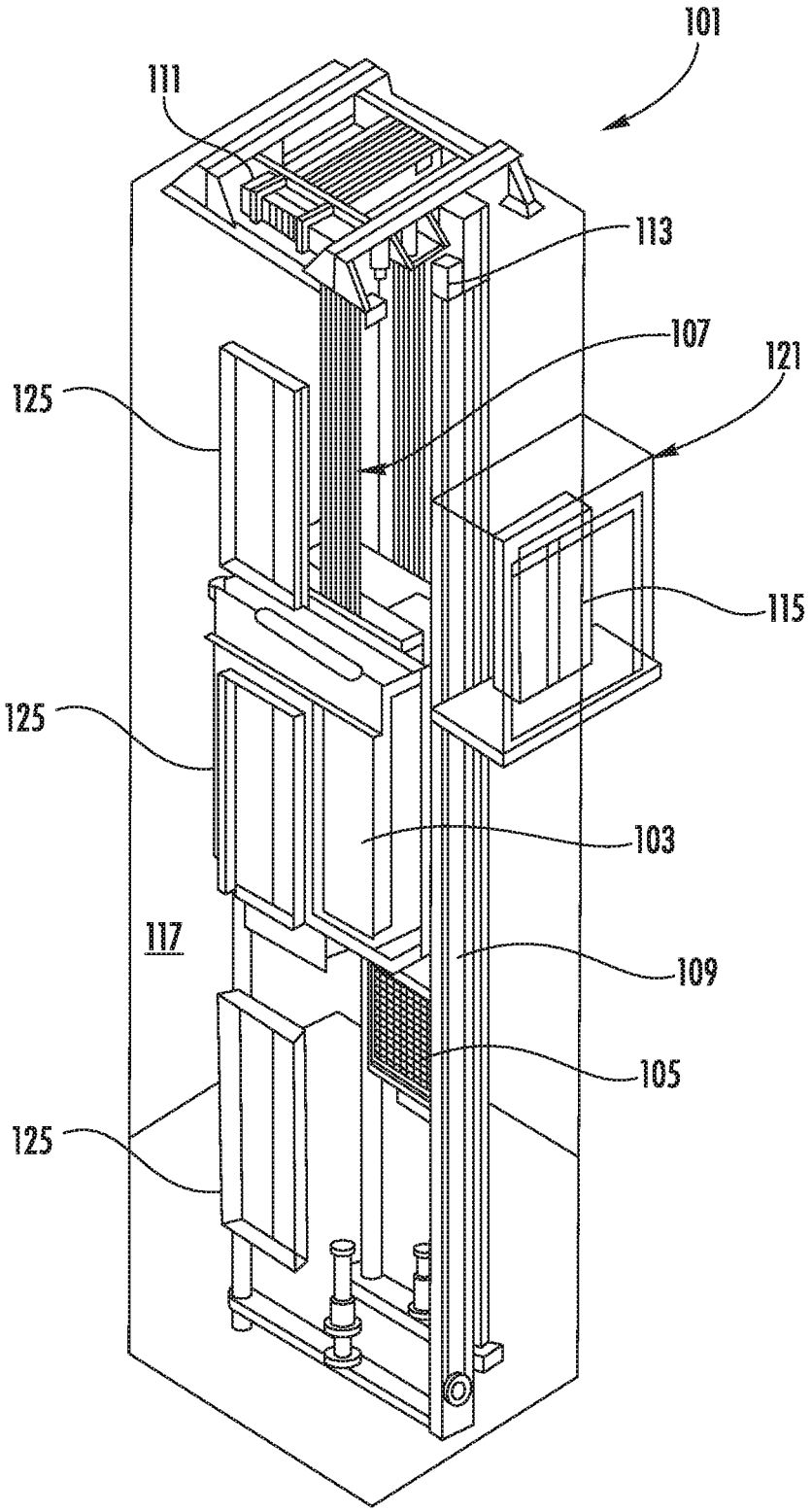
FIG. 1 is a schematic illustration of an elevator system that may employ various embodiments of the present disclosure.

FIG. 1 is a perspective view of an elevator system 101 including an elevator car 103, a counterweight 105, a tension member 107, a guide rail 109, a machine 111, a position reference system 113, and a controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The tension member 107 engages the machine 111, which is part of an overhead structure of the elevator system 101. The machine 111 is configured to control movement between the elevator car 103 and the counterweight 105. The position reference system 113 may be mounted on a fixed part at the top of the elevator shaft 117, such as on a support or guide rail, and may be configured to provide position signals related to a position of the elevator car 103 within the elevator shaft 117. In other embodiments, the position reference system 113 may be directly mounted to a moving component of the machine 111, or may be located in other positions and/or configurations as known in the art. The position reference system 113 can be any device or mechanism for monitoring a position of an elevator car and/or counter-weight, as known in the art. For example, without limitation, the position reference system 113 can be an encoder, sensor, or other system and can include velocity sensing, absolute position sensing, etc., as will be appreciated by those of skill in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position reference system 113 or any other desired position reference device. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101. In one embodiment, the controller may be located remotely or in the cloud.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. The machine 111 may include a traction sheave that imparts force to tension member 107 to move the elevator car 103 within elevator shaft 117.

Although shown and described with a roping system including tension member 107, elevator systems that employ other methods and mechanisms of moving an elevator car within an elevator shaft may employ embodiments of the present disclosure. For example, embodiments may be employed in ropeless elevator systems using a linear motor to impart motion to an elevator car. Embodiments may also be employed in ropeless elevator systems using a hydraulic lift to impart motion to an elevator car. FIG. 1 is merely a non-limiting example presented for illustrative and explanatory purposes.

Figure 2:
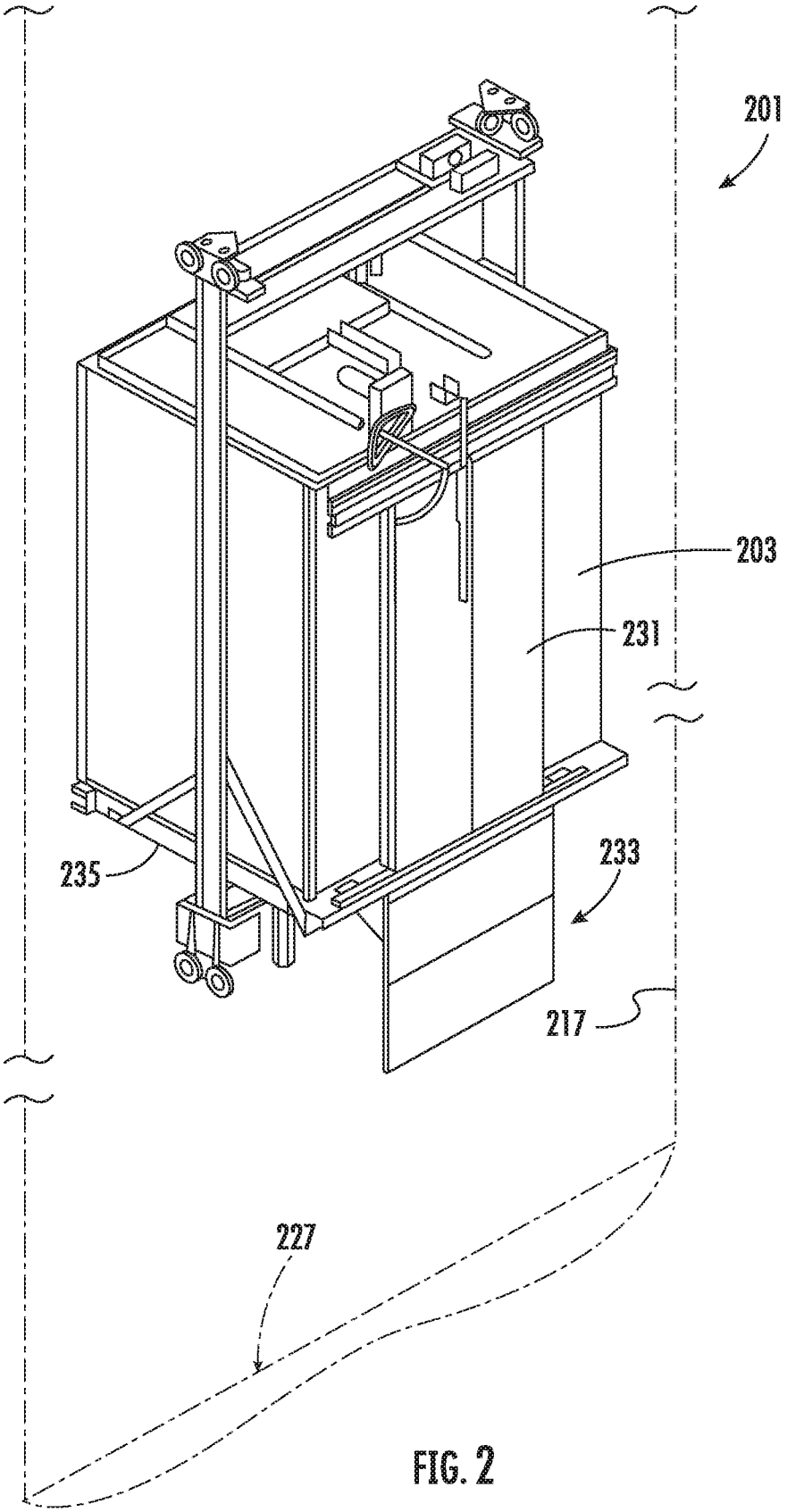
FIG. 2 is a schematic illustration of an elevator system that may employ embodiments of the present disclosure.

FIG. 2 is a schematic illustration of an elevator system 201 that can incorporate embodiments of the present disclosure. The elevator system 201 includes an elevator car 203 that is moveable within an elevator shaft 217. A pit floor 227 is shown at the bottom of the elevator shaft 217. The elevator car 203 includes elevator car doors 231 that open and close to allow ingress/egress to/from the elevator car 203 at one or more landings of the elevator system 201.

A car apron assembly 233 is provided on the elevator car 203 to cover the space between a bottom 235 of the elevator car 203 and an adjacent landing, when the elevator car 203 is in the proximity of the landing. If, for any reason, the landing doors (not shown) were to open before the elevator car 203 is properly aligned with the landing, the car apron assembly 233 is provided to at least partially block the open landing door. One function of the car apron assembly 233 is to prevent people from falling in the elevator shaft 217 during rescue operations when the elevator car door 231 is not aligned with a landing door.

However, the presence of the car apron assembly 233 impacts how close the elevator car 203 can get to the pit floor 227 of the elevator shaft 217. The example car apron assembly 233 of the present embodiment is collapsible or movable between an extended state (shown in FIG. 2) and a retracted state (not shown) that allows the elevator car 203 to descend closer to the pit floor 227 than may otherwise be possible to if the car apron assembly 233 remained in the extended state. That is, the dimensions of the car apron assembly 233 in the retracted state are significantly less than the dimensions of the car apron assembly 233 in an extended state.

In accordance with some embodiments of the present disclosure, car apron assemblies that provide landing doorway coverage and enable the use of small or low clearance pit depths in elevator systems are described. In some embodiments, the coverage provided by the car apron assemblies described herein may provide full or less-than-full coverage (e.g., ¾, ½, etc.) of an elevator landing doorway opening. In accordance with embodiments of the present disclosure, car apron assemblies are arranged to close the gap between an elevator car door sill and a landing door sill using a semi-rigid, flexible curtain having a length that can extend to a value equal to the landing door opening height. The semi-rigid curtain is fixed at its upper part below the elevator car door sill and is maintained vertical during operation of the elevator car due to a support frame that is mounted to the elevator car. The semi-rigid curtain is arranged to provide a horizontal resistance (e.g., 300 N, 35 mm deflection, and 1 mm permanent deflection) in the event of a hazard (e.g., a person contacting the semi-rigid curtain). The semi-rigid curtain provides a constant and always deployed extension to block access to the elevator shaft below the elevator car. However, when the elevator car reaches the lowest landing, the semi-rigid curtain may be compressed (e.g., crease or fold) to prevent contact with the pit floor.

Figure 3A:
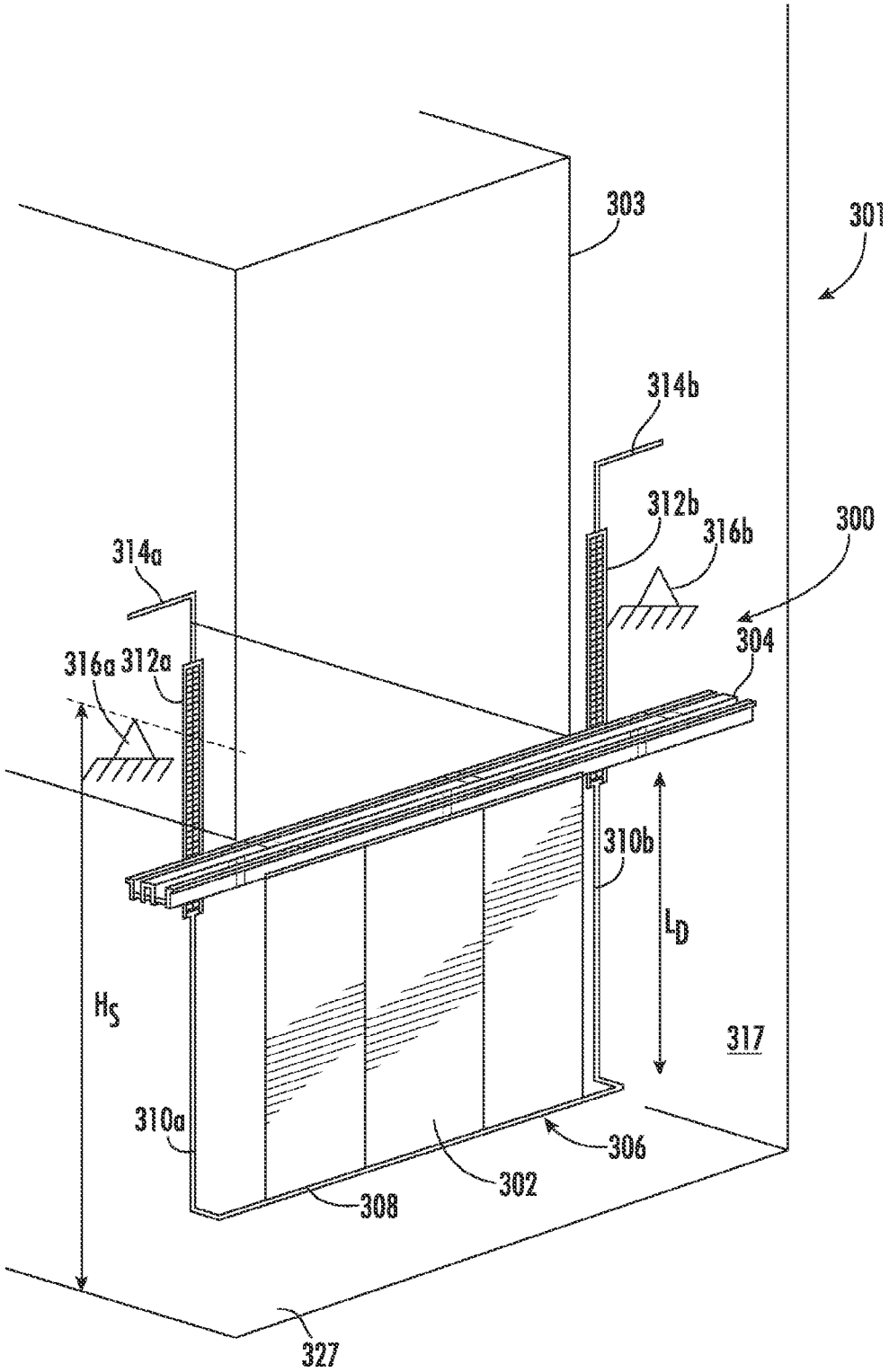
FIG. 3A is a schematic illustration of an elevator system having a car apron assembly in accordance with an embodiment of the present disclosure with the car apron assembly in a first state.
Figure 3B:
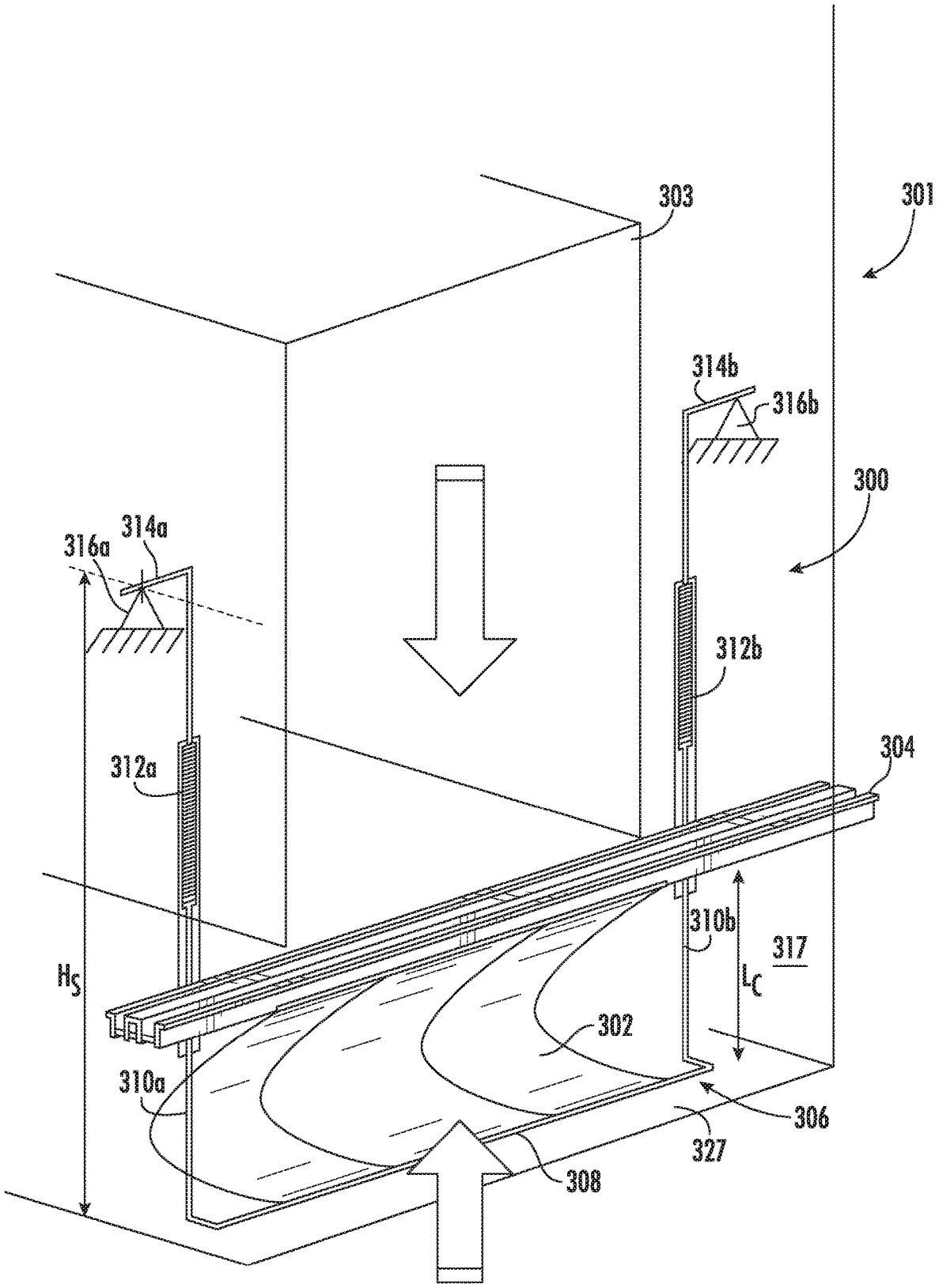
FIG. 3B is a schematic illustration of the elevator system of FIG. 3A, with the car apron assembly in a second state.

Turning now to FIGS. 3A-3B, schematic illustrations of an elevator system 301 having a car apron assembly 300 in accordance with an embodiment of the present disclosure are shown. The elevator system 301 includes an elevator car 303 that is movable within an elevator shaft 317 between a number of different landings along the elevator shaft 317. The elevator shaft 317 extends between a pit floor 327 and an elevator shaft top. Although not shown, the elevator car 303 is moveable along one or more guide rails and may be suspended from a roping system, as described above and as appreciated by those of skill in the art. At each landing, a landing door may provide openable access to the elevator car 303, when the elevator car 303 is located at the respective landing.

The car apron assembly 300 includes a semi-rigid curtain 302 that is attached to and suspended from the elevator car 303. As will be appreciated by those of skill in the art, the semi-rigid curtain 302 may be attached at an elevator car door sill 304. The semi-rigid curtain 302 extends downward from and below the elevator car 303, as shown in FIG. 3A. In the embodiment shown in FIG. 3A, the semi-rigid curtain 302 extends from the elevator car door sill 304 a deployed length $L_D$ and is supported by an apron frame 306. The apron frame 306 provides rigidity, support, and weight to the semi-rigid curtain 302. The apron frame 306, in some embodiments, may be a metal rod frame that extends a width of the semi-rigid curtain 302 to provide a weight at the bottom of the semi-rigid curtain 302 and to ensure the semi-rigid curtain 302 remains taut and aligned with an orientation of the elevator car door sill 304 (e.g., may prevent twisting of the semi-rigid curtain 302). As such, in some embodiments, the apron frame 306 may be a weighted element to apply a downward force (e.g., by gravity) on the semi-rigid curtain 302. As shown, the lower end of the semi-rigid curtain 302 may be connected to a frame base 308 of the apron frame 306. The apron frame 306 also includes support arms 310*a*, 310*b* that extend from the frame base 308 into respective biasing assemblies 312*a*, 312*b*. The support arms 310*a*, 310*b* pass through the respective biasing assemblies 312*a*, 312*b* and at an end opposite the frame base 308 each support arm 310*a*, 310*b* includes a respective apron stop 314*a*, 314*b*. The frame base 308, the support arms 310*a*, 310*b*, and the apron stops 314*a*, 314*b* form a rigid structure, and thus all elements thereof are moveable as a single unit or piece. Although shown with a support arm, biasing assembly, apron stop on each side of the elevator car 303, such arrangement is not to be limiting. For example, in some embodiments, a single support arm may pass through a single biasing assembly installed on one side of the elevator car, and a single apron stop may be arranged on the end of the support arm. In such embodiments, as will be appreciated by those of skill in the art, the apron frame 306 may be made with sufficient rigidity to function as described herein, using a single apron stop and support arm.

The biasing assemblies 312*a*, 312*b* may be piston style elements that can, in part, compress when the frame base 308 contacts the pit floor 327. The biasing assemblies 312*a*, 312*b* are fixedly mounted to an exterior of the elevator car 303, with the support arms 310*a*, 310*b* passing therethrough. Although a specific biasing assembly arrangement is shown, such embodiment is merely provided for illustrative and explanatory purposes. Other biasing arrangements may be employed without departing from the scope of the present disclosure. For example, piston-style assemblies may be employed, and various biasing elements such as, but not limited to, tension springs, compression springs, gas springs, etc. may be implemented. Further, a gravity-based biasing element or assembly may be employed without departing from the scope of the present disclosure.

The semi-rigid curtain 302 extends a deployed length $L_D$ during normal operation of the elevator car 303, as shown in FIG. 3A. The deployed length $L_D$ may have any desired length to provide fall protection in the event that a landing door is opened and the elevator car is located above the opening. In some non-limiting embodiments, the deployed length $L_D$ may be 750 mm or greater, and in some embodiment may be between 750-5000 mm, and in some embodiments, the deployed length $L_D$ may be about 750 mm.

If the elevator car 303 travels to the pit of the elevator shaft 317, the elevator car door sill 304 may approach the pit floor 327 to a distance that is less than the deployed length $L_D$. For example, as shown in FIG. 3B, the elevator car 303 has moved downward and the car apron assembly 300 is compressed to a compressed length $L_C$. To accommodate the compressed length $L_C$, the semi-rigid curtain 302 folds or compresses, as shown.

The compression of the semi-rigid curtain 302 is achieved by application of force from the apron frame 306. Proximate the pit floor 327 the elevator system 301 includes shaft stops 316*a*, 316*b* that are interactive with the apron stops 314*a*, 314*b*. The shaft stops 316*a*, 316*b* are positioned a stop height $H_s$ from the pit floor 327. The shaft stops 316*a*, 316*b* may be mounted to the shaft walls of the elevator shaft 317, mounted to a guide rail of the elevator system 301, mounted to a landing door assembly/frame (e.g., lowest landing door), or elsewhere within the elevator shaft 317. The shaft stops 316*a*, 316*b* are positioned such that if the elevator car 303 travels toward the pit floor 327 at the bottom of the elevator shaft 317, the apron stops 314*a*, 314*b* will contact the respective shaft stops 316*a*, 316*b*. The shaft stops 316*a*, 316*b* will apply force to the apron stops 314*a*, 316*b* and urge the apron frame 306 upward or away from the pit floor 327 (i.e., toward the elevator car 303). The stop height $H_s$ is set such that the apron frame 306 does not contact the pit floor 327, thus preventing damage to the apron frame 306 and/or to the semi-rigid curtain 302. When the elevator car 303 travels away from the pit floor 327, the biasing assemblies 312*a*, 312*b* will cause the apron frame 306 and the semi-rigid curtain 302 to move back to the deployed state.

In some non-limiting embodiments, the car apron assembly 300 may be arranged to meet certain predetermined criteria. For example, the deployed length $L_D$ of the semi-rigid curtain 302 may be at least two meters to ensure that a landing door opening would be covered during a rescue operation. Further, the apron frame 306 and the material of the semi-rigid curtain 302 may be selected to prevent a specific deflection and/or impacts and thus prevent persons or objects from falling into the elevator shaft 317. For example, the car apron assembly 300 may be arranged to provide a horizontal resistance (e.g., from a landing into the elevator shaft 317) of between 200-700 N with between a 5-50 mm deflection. Further, in some embodiments, the resistance may be between 300-500 N with a 15-35 mm deflection. In some embodiments, the apron assembly may be configured to have a maximal permanent deflection of about 1 mm.

It is noted that in addition to providing a safety cover or protection at a landing, the car apron assembly 300 is arranged to allow for simple operation at the lowest level of the elevator shaft 317 and/or at the pit floor 327. For example, the semi-rigid curtain 302 may be collapsible such that when the apron stops 314*a*, 314*b* of the car apron assembly 300 contact the shaft stops 316*a*, 316*b*, the semi-rigid curtain 302 may compress (e.g., crease, collapse, fold upon itself, etc.) to a compressed state.

Figures 4A, 4B, 4C:
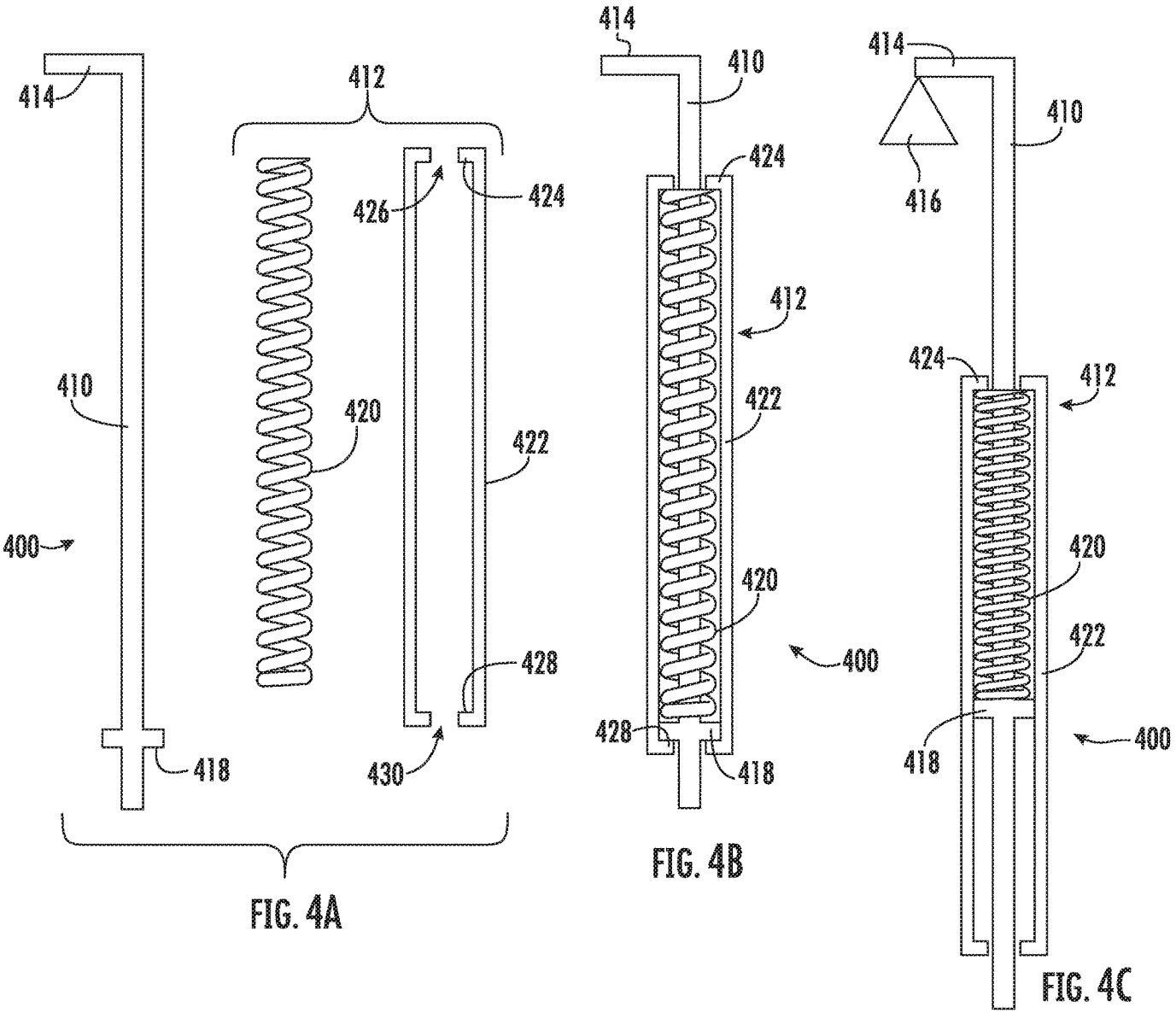
FIGS. 4A-4C are illustrative schematic views of operation of a car apron assembly in accordance with a non-limiting embodiment of the present disclosure.

Turning now to FIGS. 4A-4C, schematic illustrations of a portion of a car apron assembly 400 in accordance with an embodiment of the present disclosure are shown. FIG. 4A is an exploded or disassembled illustration, FIG. 4B is illustrative of the car apron assembly 400 during normal operation of an elevator car, and FIG. 4C is illustrative of the car apron assembly 400 during a compressed state, such as when an apron stop 414 contacts a shaft stop, as described above. FIGS. 4A-4C illustrate a support arm 410 passing through a biasing assembly 412, with the support arm 410 having an apron stop 414 on an end thereof. The support arm 410 extends downward to a frame base (not shown) similar to that shown and described above.

As shown in FIG. 4A, the support arm 410 includes the apron stop 414 at an end thereof. The support arm 410 further includes a flange 418. The flange 418 is arranged to interact with part of the biasing assembly 412, as described herein.

The biasing assembly 412 includes a biasing element 420 and a housing 422. The biasing element 420 is housed within the housing 422 and is arranged to interact with the support arm 410, and particularly the flange 418 thereof. The housing 422 is arranged to fixedly attach or connect to a part of an elevator car, such as a frame or panel. The housing 422 has a first end 424 defining a first aperture 426 and a second end 428 defining a second aperture 430. The first end 424 and the second end 428 are arranged to operate as stops or bounds for movement and/or compression of the flange 418 of the support arm 410 and the biasing element 420. The support arm 410 is arranged to pass through the first and second apertures 426, 430 of the housing 422 and the interior of the housing 422. In some embodiments, the biasing element 420 is a spring.

Referring to FIG. 4B, an illustration of the support arm 410, the biasing element 420, and the housing 422 as assembled is shown. As assembled, the elements 410, 420, 422 form a part of a car apron assembly 400, such as shown and described above. In FIG. 4B, the car apron assembly 400 and the biasing element 420 are shown in a normal operational state, such as when an elevator car is operating in a normal operating mode and the apron stop 414 has not contacted a shaft stop. As shown, the flange 418 of the support arm 410 is located at the second end 428 of the housing 422 and the biasing element 420 extends substantially from the first end 424 to the second end 428 of the housing 422.

Turning now to FIG. 4C, actuation of the car apron assembly 400 is shown. Actuation is performed when the apron stop 414 contacts a shaft stop 416. As the support arm 410 is stopped by the shaft stop 416 and the elevator car continues to move downward relative to the shaft stop 416, the flange 418 of the support arm 410 will compress the biasing element 420 against the first end 424 of the housing 422. Accordingly, the shaft stop 416 acts to urge the support arm 410 upward and through the housing 422 of the biasing assembly 412, and relative to the elevator car. As such, a semi-rigid curtain that is mounted to the apron frame, which includes the support arm 410, will fold or compress as the apron frame is moved relative to the elevator car. That is, the movement of the elevator car causes the compression of the semi-rigid curtain because the shaft stops will cause the support arms to stop movement relative to the elevator car which may continue to move toward the pit floor.

When the elevator car moves upward in the elevator shaft relative to the shaft stop, the biasing element 420 will urge the support arm 410 back to the original or operational position by applying force to the flange 418 of the support arm 410. Thus, when the elevator car is not proximate the pit of the elevator shaft, and thus no contact exists between the shaft stop 416 and the apron stop 414, the semi-rigid curtain may be returned to a protective and deployed state, such as shown in FIG. 3A.

Although shown in FIGS. 4A-4C with the biasing element 420 being compressed by the flange 418 during operation, other arrangements are possible. For example, still employing a spring-like arrangement, the spring may be arranged to be extended from the second end when the shaft stop contacts the apron stop (i.e., the biasing element is positioned between the flange 418 and the second end 428 and is connected to the flange 418 and the second end 428). In another embodiment, rather than employing a spring assembly, the biasing assembly 412 can be arranged as a piston using fluid or gas that may be compressed and expanded during operation. Other possible arrangements may be employed without departing from the scope of the present disclosure, as will be appreciated by those of skill in the art.

To enable the compression of the semi-rigid curtain, while maintaining appropriate or desirable resistance to force/impact, the semi-rigid curtain may be formed from a specific material that enables the collapsing and re-deployment and have strength thereto. For example, in some embodiments, without limitation, the semi-rigid curtain of the present disclosure may be formed from rubber, plastic (e.g., a tarp-like material, etc.), fabric (e.g., canvas, nylon, etc.), metallic and/or plastic chain links, metal or plastic mesh, etc. In some embodiments, the material of the semi-rigid curtain may be selected to ensure a relatively quiet folding when contacting the pit floor or anchors of the system. Further, the material may be selected to minimize a total weight of the car apron assembly. Moreover, the selection of the material may be made to ensure that in a compressed state the semi-rigid curtain may fold into a preset space, and yet extend to a full length in normal operation. For example, in one non-limiting example, the semi-rigid curtain may have a deployed length of greater than 1 meter, and a collapsed or folded dimension of less than 750 mm. Further, in some non-limiting embodiments, the deployed length may be between 750 mm and 5 meters and the collapsed dimension may be between 0 and 750 mm. Further still, in some embodiments, the deployed length may be about 750 mm and the collapsed dimension may be about 180 mm.

Advantageously, embodiments described herein provide a protective car apron assembly to prevent accidental falls into an elevator shaft when an elevator car is positioned offset from a landing. Further, advantageously, the car apron assemblies of the present disclosure can provide falling hazard protection, enables low pits (due to foldability), may be scalable to different elevator systems, and may provide various other advantages as appreciated by those of skill in the art.

The term "about" is intended to include the degree of error associated with measurement of the particular quantity and/or manufacturing tolerances based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. An elevator system comprising:

an elevator car movable along an elevator shaft, the shaft having a pit floor, the elevator car having an elevator car door sill;

a car apron assembly comprising:

an apron frame movably mounted to the elevator car, the apron frame having a frame base, a support arm, and an apron stop at an end of the support arm opposite the frame base;

a semi-rigid curtain attached to the elevator car door sill and extending to the frame base; and a shaft stop arranged within the elevator shaft at a stop height from the pit floor, the shaft stop positioned within the elevator shaft to interact with the apron stop, wherein:

the semi-rigid curtain transitions from a deployed state to a compressed state when the apron stop contacts the shaft stop and as the elevator car moves toward the pit floor, and when in the deployed state the semi-rigid curtain extends below the elevator car to block an open landing door that is lower than the elevator car when the elevator car is positioned offset and above an adjacent landing; and a biasing assembly through which the support arm having the apron stop passes, wherein the biasing assembly applies a biasing force to urge the apron frame into the deployed state.

2. The elevator system of claim 1, wherein the semi-rigid curtain is formed from at least one of rubber, plastic, fabric, metallic chain links, plastic chain links, metal mesh, and plastic mesh.

3. The elevator system of claim 2, wherein the semi-rigid curtain has a deployed length $L_D$ in the deployed state and a compressed length $L_C$ in the compressed state, wherein the compressed length $L_C$ is less than the deployed length $L_D$.

4. The elevator system of claim 2, wherein the semi-rigid curtain provides a horizontal resistance of between 200-700 N with a 5-50 mm deflection, in particular with a horizontal resistance of about 300 N with about a 35 mm deflection.

5. The elevator system of claim 1, wherein the semi-rigid curtain has a deployed length $L_D$ in the deployed state and a compressed length $L_C$ in the compressed state, wherein the compressed length $L_C$ is less than the deployed length $L_D$.

6. The elevator system of claim 5, wherein the semi-rigid curtain has a length of between 750 mm and 5 meters in the deployed state and between 0 and 750 mm in the compressed state, in particular having a length of about 750 mm in the deployed state and about 180 mm in the compressed state.

7. The elevator system of claim 5, wherein the semi-rigid curtain provides a horizontal resistance of between 200-700 N with a 5-50 mm deflection, in particular with a horizontal resistance of about 300 N with about a 35 mm deflection.

8. The elevator system of claim 1, wherein the shaft stop is fixedly connected to at least one of a shaft wall, a landing door frame, and a guide rail.

9. The elevator system of claim 1, wherein the biasing assembly comprises a housing and a biasing element within the housing.

10. The elevator system of claim 9, wherein the housing of the biasing assembly comprises a first end with a first aperture in the first end and a second end with a second aperture in the second end, wherein the support arm passes through the housing from the first end to the second end.

11. The elevator system of claim 9, wherein the biasing element is a spring.

12. The elevator system of claim 9, wherein the biasing assembly is mounted to the elevator car.

13. The elevator system of claim 1, wherein the biasing assembly comprises a spring.

14. The elevator system of claim 1, wherein the support arm comprises a flange that is arranged to apply force to a biasing element of the biasing assembly when the apron stops contact the shaft stops.

15. The elevator system of claim 1, wherein the biasing assembly is mounted to the elevator car.

16. The elevator system of claim 15, wherein the biasing assembly is mounted to at least one of a frame of the elevator car and a panel of the elevator car.

17. The elevator system of claim 1, wherein the semi-rigid curtain provides a horizontal resistance of between 200-700 N with a 5-50 mm deflection, in particular with a horizontal resistance of about 300 N with about a 35 mm deflection.

18. The elevator system of claim 1, wherein the apron frame comprises a second support arm having an associated second apron stop and wherein a second shaft stop is arranged within the elevator shaft to interact with the second apron stop.

19. The elevator system of claim 18, wherein the first and second support arms and the first and second apron stops are located on opposite sides of the elevator car.

* * * * *